US006146154A

United States Patent [19]

Lin

[11] Patent Number: 6,146,154

[45] Date of Patent: Nov. 14, 2000

[54] LIGHT BULB HOLDER STRUCTURE

[76] Inventor: Chien-Yu Lin, PMB #1008, 1867 Ygnacio Valley Rd., Walnut Creek, Calif. 94598

[21] Appl. No.: 09/472,794

[22] Filed: Dec. 28, 1999

[51] Int. Cl.[7] ..... H01R 13/66

[52] U.S. Cl. ..... 439/76.1; 362/394; 200/51.17

[58] Field of Search ..... 439/336, 613, 439/615, 620, 76.1, 666, 667; 200/51.14, 51.15, 51.16, 51.17; 362/411, 494, 495

[56] References Cited

U.S. PATENT DOCUMENTS

| | | | |
|---|---|---|---|
| 948,670 | 2/1910 | McLewee . | |
| 1,214,644 | 2/1917 | Both . | |
| 1,952,783 | 3/1934 | Tamol . | |
| 2,775,663 | 12/1956 | Rummage . | |
| 3,543,088 | 11/1970 | Garrett . | |
| 4,183,604 | 1/1980 | Tjornhom, Sr. | 339/78 |
| 4,343,032 | 8/1982 | Schwartz | 362/276 |
| 4,613,790 | 9/1986 | Roorda | 315/72 |
| 4,764,708 | 8/1988 | Roudeski | 315/51 |

*Primary Examiner*—Steven L. Stephan
*Assistant Examiner*—Thanh-Tam Le
*Attorney, Agent, or Firm*—A & J

[57] ABSTRACT

An improved light bulb holder structure includes a housing, a heat insulation layer, a main body, and a bottom cover. The main body is disposed inside the housing. The heat insulation layer is disposed between the housing and the main body. The bottom cover is fitted and fastened to a bottom portion of the housing. The main body includes a substrate plate and a connecting seat. The substrate plate includes a printed circuit board having a stepless switch and necessary electronic components thereof soldered thereon. Three upwardly extending upper terminals are soldered to an upper side of the circuit board to be secured with the connecting seat as an integral whole. Two downwardly extending lower terminals are provided on a lower side of the circuit board to connect to electrical wires of a power source. The improved light bulb holder has advantages of cost and material savings.

1 Claim, 3 Drawing Sheets

LIGHT BULB HOLDER STRUCTURE

BACKGROUND OF THE INVENTION (a) Field of the Invention

The present invention relates to an improved light bulb holder structure, more particularly to light bulb holder in which a printed circuit board is adapted as a base and is directly connected with a stepless switch, and has upper terminals secured with a connecting seat for receiving a light bulb, and lower terminals connected to a power source, whereby manufacturing costs can be reduced considerably.

(b) Description of the Prior Art

FIG. 5 shows a conventional light bulb holder which includes a cylindrical base 21 connected to a connecting seat 22 adapted for receiving a light bulb and being disposed in a housing 1. A bottom cover 3 is fitted to a bottom portion of the housing 1. The base 21 has a switch 23 and a power source terminal 24 provided thereon. The electrical path between the switch 23 and the connecting seat 22 is achieved via the power source terminal 24 that is connected to an electric power source. The switch 23 controls the connection and disconnection of power to the connecting seat 22.

With the advance of high-tech products, traditional industries, in order to survive competition, aim to reduce manufacturing costs and simplify manufacturing process. It is difficult to lower the costs of making the conventional light bulb holder in view of the molded base 21, which is relatively expensive to manufacture in terms of time and material.

SUMMARY OF THE INVENTION

A primary object of the present invention is to provide an improved light bulb holder that is inexpensive to manufacture and that is simple to assembly.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
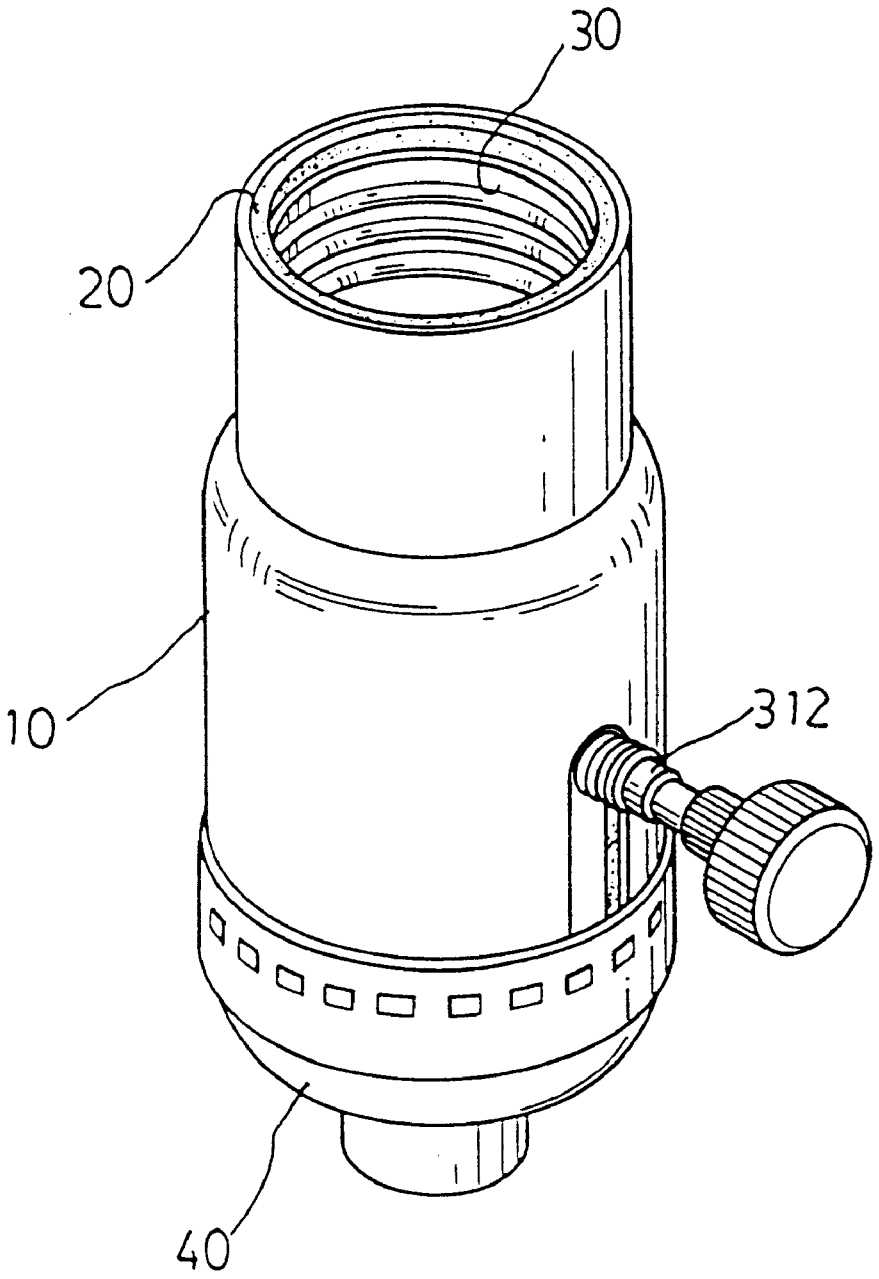
FIG. 1 is a perspective view of the present invention.
Figure 2:
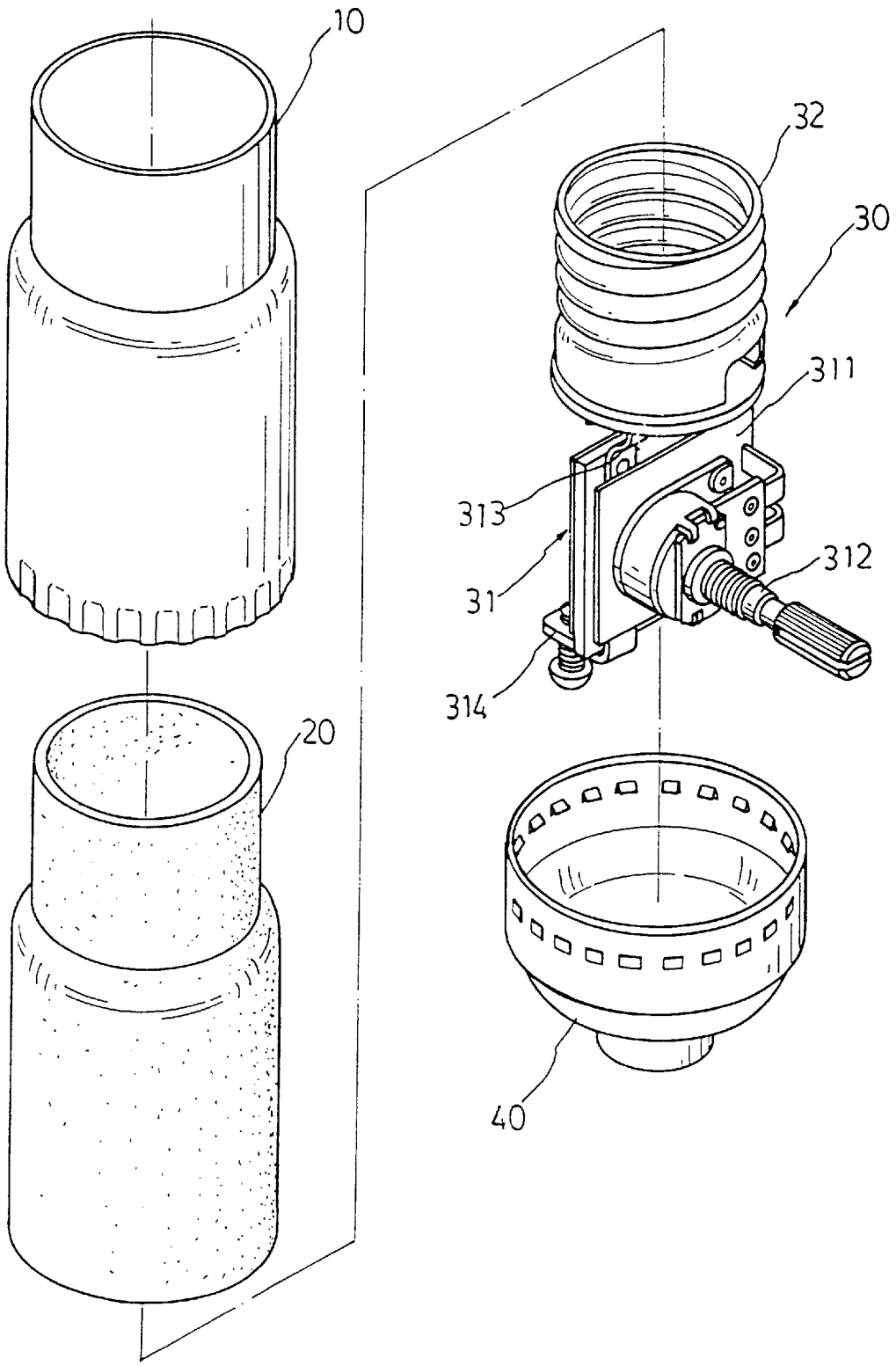
FIG. 2 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
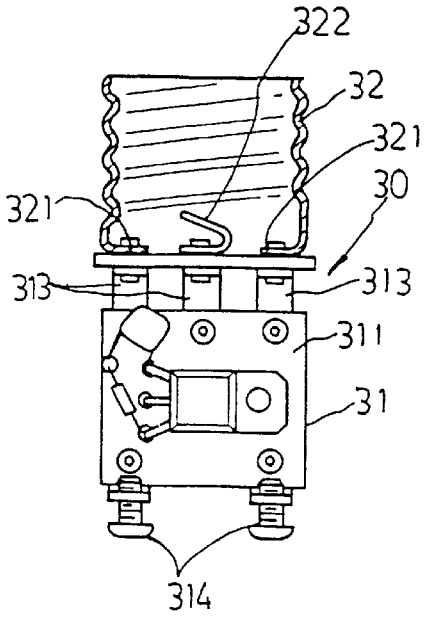
FIG. 3 is a side view of the present invention.
Figure 4:
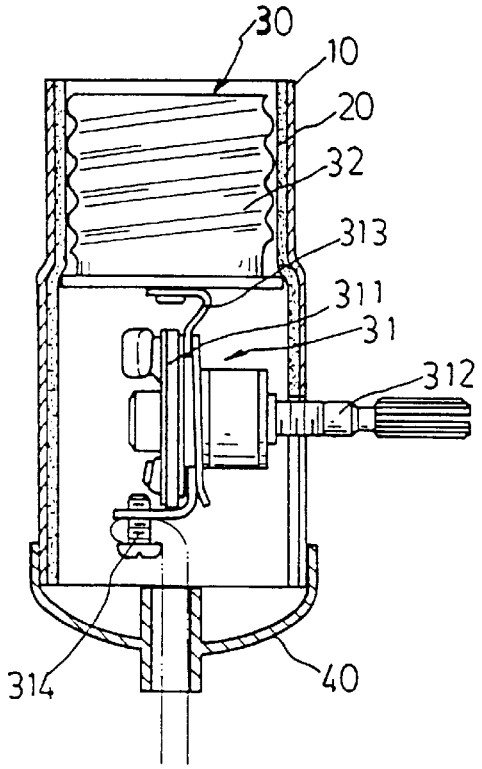
FIG. 4 is a sectional view of the present invention.
Figure 5:
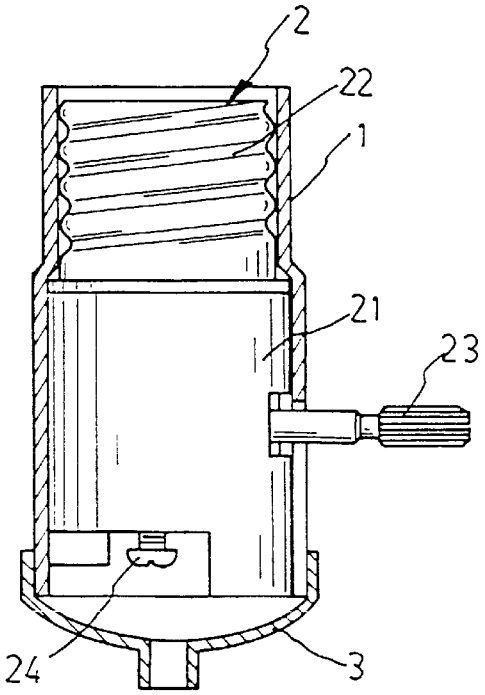
PRIOR ART FIG. 5
FIG. 5 is a sectional schematic view of the prior art.

With reference to FIGS. 1 to 4, the present invention comprises a housing 10, a heat insulation layer 20, a main body 30, and a bottom cover 40. The main body 30 is insertably disposed in the housing 10, and the heat insulation layer 20 is disposed between the housing 10 and the main body 30. The bottom cover 40 is fitted and fastened to a bottom portion of the housing 10, thereby completing assembly of a light bulb holder of the present invention. An improvement of the present invention resides in that the main body 30 includes a thin and small substrate plate 31 and a connecting seat 32 secured therewith. The substrate plate 31 includes mainly a printed circuit board 311. A stepless switch 312 is soldered directly onto the circuit board 311. With reference to FIG. 3, three upwardly extending upper terminals 313 are secured on an upper side of the circuit board 311, while two downwardly extending lower terminals 314 are secured on a lower side of the circuit board 311. It should be understood that other necessary electronic components are also soldered on the circuit board 311. The two lower terminals 314 are adapted for connection with electrical wires of a power source, while the upper terminals 313 are secured with the connecting seat 32 as an integral whole. One of the upper terminals 313 (the middle one) is electrically connected to an electrically conductive reed 322 inside the connecting seat 2, the other two upper terminals 313 are connected to a conductive connecting face 321 at the bottom portion of the connecting seat 32. Electric power is supplied via the lower terminals 314 to the circuit board to control the on/off operation of the connecting seat 32 through the stepless switch 312. A light bulb holder having a printed circuit board as a substrate plate is different from one having a cylindrical base, and eliminates costs in relation to injection molding the base, thereby reducing the manufacturing costs.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved light bulb holder structure comprising a housing, a heat insulation layer, a main body, and a bottom cover, the main body being disposed inside the housing, the heat insulation layer being disposed between the housing and the main body, the bottom cover being fitted and fastened to a bottom portion of the housing, wherein the main body includes a substrate plate and a connecting seat, the substrate plate including a printed circuit board having a stepless switch and necessary electronic components thereof soldered thereon, three upwardly extending upper terminals being soldered to an upper side of the circuit board to be secured with the connecting seat as an integral whole, two downwardly extending lower terminals being provided on a lower side of the circuit board to connect to electrical wires of a power source, whereby the main body comprised of the substrate plate and the connecting seat may reduce considerably manufacturing costs of light bulb holders.

* * * * *